US005881751A

United States Patent [19]

Hofmann et al.

[11] Patent Number: 5,881,751

[45] Date of Patent: Mar. 16, 1999

[54] APPARATUS FOR REMOVING RESIDUES, PARTICULARLY FOR DECONTAMINATING NUCLEAR INSTALLATIONS

[75] Inventors: Jürgen Hofmann, Salzwedel; Bernd Birkicht, Grossbottwar, both of Germany

[73] Assignees: TZN Forschungs- und Entwicklungs-zentrum Unterlüss, Unterlüss; Telerob Ges. für Fernhantierungs-technik GmbH, Kiel, both of Germany

[21] Appl. No.: 795,315

[22] Filed: Feb. 3, 1997

[30] Foreign Application Priority Data

Feb. 3, 1996 [DE] Germany ..... 196 03 902.9

[51] Int. Cl.[6] ..... B08B 3/04; B08B 3/10; B08B 7/02; B08B 9/00

[52] U.S. Cl. ..... 134/169 R; 134/166 R; 134/169 C; 134/104.4; 134/22.1; 134/1

[58] Field of Search ..... 134/1, 22.1, 166 R, 134/169 R, 169 C, 104.4

[56] References Cited

U.S. PATENT DOCUMENTS

| | | | |
|---|---|---|---|
| 4,470,952 | 9/1984 | Vassalotti | 376/316 |
| 4,699,665 | 10/1987 | Scharton et al. | 134/1 |
| 4,847,042 | 7/1989 | Musiol et al. | 376/316 |

FOREIGN PATENT DOCUMENTS

| | | |
|---|---|---|
| 0 112 576 | 7/1984 | European Pat. Off. . |
| 0 373 936 | 6/1990 | European Pat. Off. . |
| 2 642 889 | 8/1990 | France . |
| 32 38 886 | 4/1984 | Germany . |
| 34 47 827 | 7/1986 | Germany . |

OTHER PUBLICATIONS

Derwent Publications, Ltd., XP 002044812 & SU 452 251, Nov. 12, 1997.

Derwent Publications, Ltd., XP 002044813 & ZA 8 907 864, Jul. 15, 1990.

*Primary Examiner*—Zeinab El-Arini

*Attorney, Agent, or Firm*—Venable; Gabor J. Kelemen

[57] ABSTRACT

A method and an apparatus for removing residues from an inner wall surface of a liquid-filled vessel includes a submergible carrier unit drivable in liquid; a coaxial, multi-pole electrode system mounted on the carrier unit; an arrangement for steering the carrier unit to a desired location at the wall surface; and a high-power pulse generator connected with the electrode system for generating a shock wave to be applied to the wall surface at the desired location, whereby the push-pull effect of the forces derived from the shock wave causes the residues to loosen and drop off the wall surface.

4 Claims, 2 Drawing Sheets

APPARATUS FOR REMOVING RESIDUES, PARTICULARLY FOR DECONTAMINATING NUCLEAR INSTALLATIONS

CROSS REFERENCE TO RELATED APPLICATION

This application claims the priority of German Application No. 196 03 902.9 filed Feb. 3, 1996, which is incorporated herein by reference.

BACKGROUND OF THE INVENTION

This invention relates to a method of and an apparatus for removing residues particularly for the purpose of decontaminating nuclear installations and vessels.

A mechanical removal of residues from the surfaces of vessels and pipe conduits involves significant problems. The result of conventional processes is a loosening of the material rather than a removal thereof from the surface. The crusts are wedged on the surface and thus, although loose, they are not ready to drop off the vessel or pipe surface.

To effect an actual complete separation of the residues from the surface to be cleaned, German Patent No. 3,447,827 discloses a method and an apparatus which can be used similarly to pipe-cleaning hoses having a nozzle head. Other tools such as a steel brush may be moved laterally at the nozzle head in a longitudinal direction by intermittently applying fluid to a hydraulic cylinder. Other tools, for example, a hammer or hammers may be used with such an apparatus. It is a disadvantage of this arrangement that the residues and deposits are removed in an irregular manner and further, the apparatus may not treat locations which are not readily accessible.

Nuclear and chemical installations and reservoirs are often highly contaminated by sedimented residues. For a decontamination of such residues it is known to use chemical solvents. It is a disadvantage of such processes that a full decontamination by the permissible solvents cannot be effected.

Further, the use of supersonic devices for removing residues is also known. Thus, for avoiding damages during removal of deposits on fuel elements by means of ultrasonic waves, according to German Patent No. 3,238,886 the fuel elements are exposed simultaneously from opposite sides to ultrasonic waves of identical power. Such an arrangement, however, cannot be used in nuclear installations. It is a further disadvantage of such ultrasonic devices that high energy losses occur while the effective working radius is small.

According to a further well known process sandblasting is used for decontaminating nuclear installations. It is a drawback of sandblasting that secondary waste is generated. Thus, for example, the sand settles and also has to be removed which requires an additional energy input.

SUMMARY OF THE INVENTION

It is an object of the invention to provide a contactless method and apparatus for removing highly radioactive residues even in a densely structured environment.

This object and others to become apparent as the specification progresses, are accomplished by the invention, according to which, briefly stated, the method and apparatus for removing residues from an inner wall surface of a liquid-filled vessel includes a submergible carrier unit drivable in liquid; a coaxial, multi-pole electrode system mounted on the carrier unit; an arrangement for steering the carrier unit to a desired location at the wall surface; and a high-power pulse generator connected with the electrode system for generating a shock wave to be applied to the wall surface at the desired location, whereby the push-pull effect of the forces derived from the shock wave causes the residues to loosen and drop off the wall surface.

DESCRIPTION OF THE PREFERRED EMBODIMENT

Figure 1:
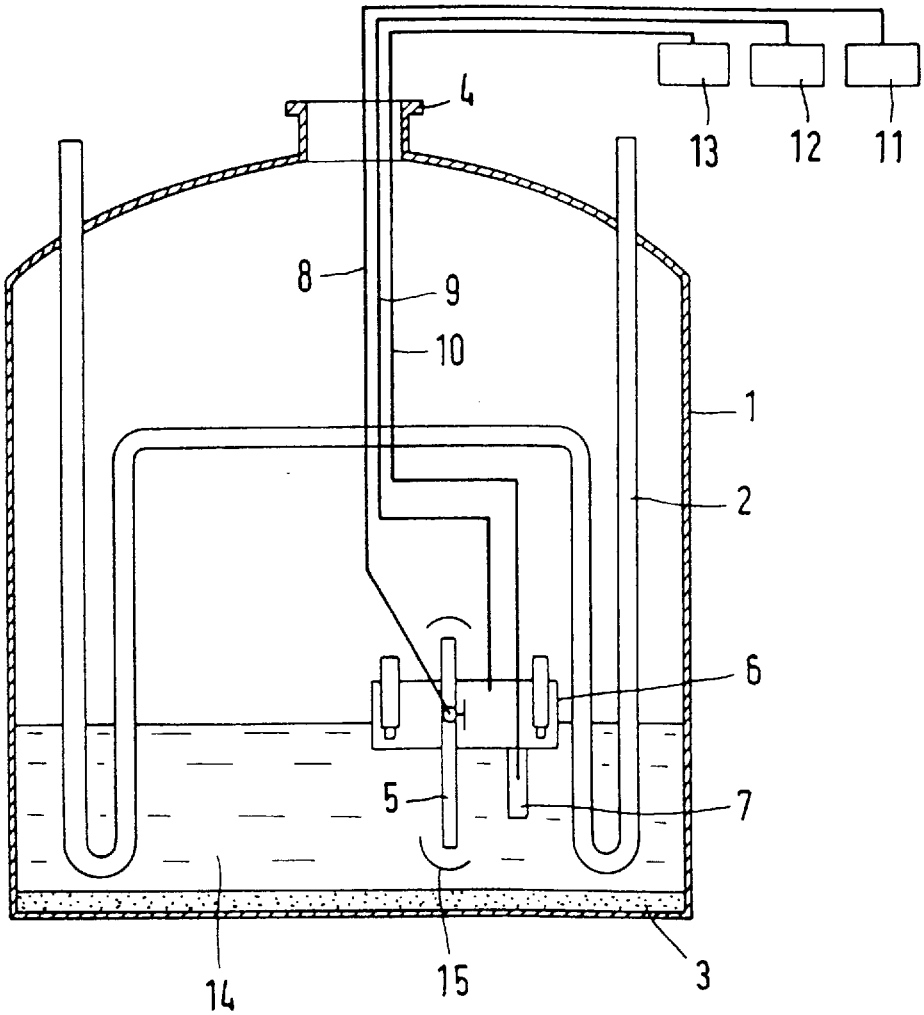
FIG. 1 is a schematic elevational view, with block diagram, illustrating a preferred embodiment of the invention.

FIG. 1 illustrates a vessel 1 to be decontaminated. The vessel accommodates pipes 2 not described in further detail. A submergible carrier unit 6 drivable in liquid and carrying a coaxial energy supply cable 8, a control cable 9 and a pump conduit 10 is introduced into the vessel 1 through its upper opening 4. The vessel 1 further contains a liquid carrier medium 14. An energy supply device 11, a control device 12 (for example, a joystick for steering the carrier unit 6) as well as a receiving container 13 for the removed residues 3 are arranged preferably externally of the vessel 1 and are connected to the cables 8 and 9 as well as to the conduit 10, respectively. A coaxial, multi-pole electrode system 5 connected with the energy source 11 by means of the cable 8 and a pump 7 coupled to the pump conduit 10 are mounted on the carrier unit 6.

In the description which follows, the operation of the above-described apparatus will be set forth.

Figure 2:
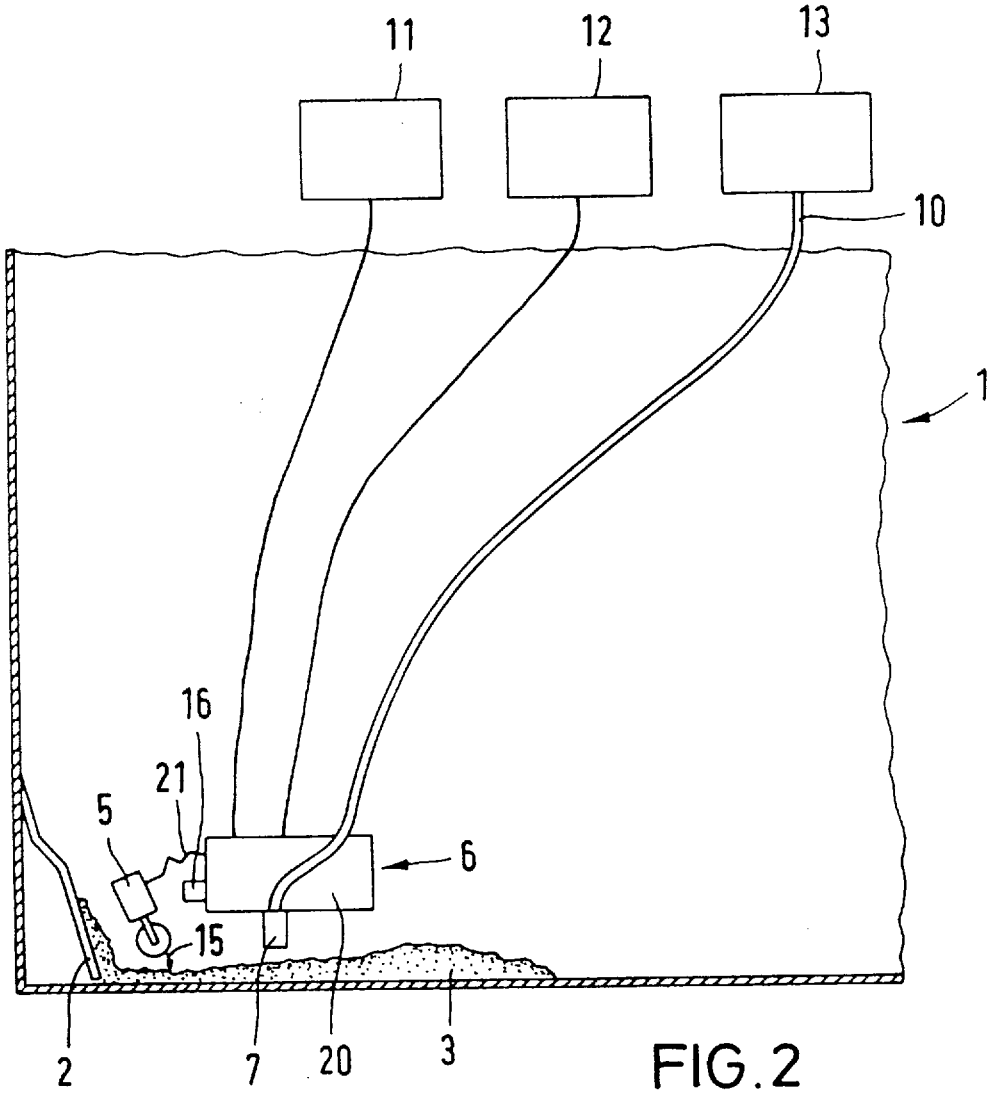
FIG. 2 is a schematic elevational detail of the structure shown in FIG. 1.

The carrier unit 6, together with the electrode system 5 and the pump 7 is introduced into the vessel 1 through the upper vessel opening 4 (which may be designed as a vessel lock). By means of the control device 12, the carrier unit 6 is, as shown in FIG. 2, steered to the vicinity of the residues 3 to be removed from the bottom wall of the vessel 1. After positioning the electrode system 5 in the vicinity of the residues 3, high-power pulses 15 are applied thereto which are generated in a conventional manner in the energy supply device 11 by means of a d.c. pulse-generating source and a capacitor battery (neither shown). The pulse is discharged through a triggered spark gap of the electrode system 5 submerged in the carrier liquid 14. Dependent on the strength of the high-power pulse 15 and thus the pressure pulses resulting therefrom as well as the instabilities of the material of the residues to be removed, the residues 3 are exposed to pressing and pulling stresses which cause full separation of the residues 3 from the wall surface to be decontaminated. The energy of the high-power pulse 15 is 2–20 KJ dependent upon the thickness and properties of the residues 3. The residues 3 separated from the wall of the vessel are pumped out of the vessel 1 by the pump 7 through the pump line 10. In the container 13 a substance separation is effected, that is, the liquid carrier medium 14 is separated from the residues 3 and is reintroduced into the vessel 1.

The carrier unit 6, which, in addition to the electrode system 5 and the pump 7 also carries a monitoring and verifying device 16, is steered in a conventional manner by operating the joystick 12. Thus, the control may be effected by measuring instruments of the monitoring and verifying device 16, that is, by means of radiation values or by a visual guidance with the aid of cameras. The carrier unit 6, by means of the device 16, monitors the cleaning process and upon a complete removal of the residues 3 from the area under treatment the electrode system 5 is, by the carrier unit 6, moved to a new position.

The structure of the carrier unit 6 is as follows:

The electrode system 5 is movably supported on a housing 20 of the carrier unit 6 by means of joints 21. The pump 7 is situated preferably underneath the carrier unit 6 and may be secured thereto in a fixed or in a flexible manner. The monitoring and verifying device 16 is located preferably in the vicinity of the electrode system 5. In this arrangement a non-illustrated camera may be placed directly at the electrode system 5 for visually tracking the decontamination. It is, however, simpler to attach the device 16 to the housing 20 which is preferably of high-grade steel and is watertight. The housing 20 of the carrier unit 6 may have ballast and/or air tanks, whereby the carrier unit 6 may be maneuvered similarly to a submarine.

By movably arranging the electrode system 5 on the housing 20 and by providing a submarine-like freedom of motion of the carrier unit 6, the generated pressure or shock waves may also be applied in normally inaccessible locations.

It will be understood that the above description of the present invention is susceptible to various modifications, changes and adaptations, and the same are intended to be comprehended within the meaning and range of equivalents of the appended claims.

What is claimed is:

1. An apparatus for removing residues from an inner wall surface of a liquid-filled vessel, comprising (a) a submergible carrier unit drivable in liquid;

(b) a coaxial, multi-pole electrode system mounted on said carrier unit;

(c) means for steering the carrier unit to a desired location at the wall surface; and (d) a high-power pulse generator connected with the electrode system for generating a shock wave to be applied to the wall surface at the desired location.

2. The apparatus as defined in claim 1, wherein said carrier unit includes a housing; further comprising a joint movably securing said electrode system to said housing.

3. The apparatus as defined in claim 1, further comprising a monitoring and verifying device mounted on said carrier unit.

4. The apparatus as defined in claim 1, further comprising a pump mounted on said carrier unit for conveying away residues removed from the wall surface.

* * * * *